US008453170B2

(12) United States Patent
Briggs et al.

(10) Patent No.: US 8,453,170 B2
(45) Date of Patent: May 28, 2013

(54) SYSTEM AND METHOD FOR MONITORING AND RECOGNIZING BROADCAST DATA

(75) Inventors: Darren P. Briggs, Nashville, TN (US); Richard C. Wardwell, III, Nashville, TN (US)

(73) Assignee: Landmark Digital Services LLC, Nashville, TN (US)

( * ) Notice: Subject to any disclaimer, the term of this patent is extended or adjusted under 35 U.S.C. 154(b) by 172 days.

(21) Appl. No.: 11/679,291

(22) Filed: Feb. 27, 2007

(65) Prior Publication Data

US 2008/0208851 A1 Aug. 28, 2008

(51) Int. Cl.
*H04H 20/14* (2008.01)
*H04H 60/29* (2008.01)

(52) U.S. Cl.
USPC ..... 725/22; 725/32; 725/33; 725/34; 725/35; 725/36

(58) Field of Classification Search
USPC ..... 725/9, 22, 10–11, 13–14, 17, 19, 725/21, 32–36, 31; 707/6; 455/2.01
See application file for complete search history.

(56) References Cited

U.S. PATENT DOCUMENTS

| | | | | |
|---|---|---|---|---|
| 4,415,767 | A | 11/1983 | Gill et al. | |
| 4,450,531 | A | 5/1984 | Kenyon et al. | |
| 4,843,562 | A | 6/1989 | Kenyon et al. | |
| 4,852,181 | A | 7/1989 | Morito et al. | |
| 5,210,820 | A | 5/1993 | Kenyon | |
| 5,276,629 | A | 1/1994 | Reynolds | |
| 5,400,261 | A | 3/1995 | Reynolds | |
| 5,436,653 | A * | 7/1995 | Ellis et al. | 725/22 |
| 5,918,223 | A | 6/1999 | Blum et al. | |
| 6,021,491 | A | 2/2000 | Renaud | |

(Continued)

FOREIGN PATENT DOCUMENTS

| | | |
|---|---|---|
| CN | 1219810 | 6/1999 |
| JP | 07-079206 | 3/1995 |

(Continued)

OTHER PUBLICATIONS

International Search Report and Written Opinion issued for PCT/US2008/055001; Dated: Jun. 27, 2008; 10 Pages.

(Continued)

*Primary Examiner* — Pankaj Kumar
*Assistant Examiner* — Alazar Tilahun
(74) *Attorney, Agent, or Firm* — Woodcock Washburn LLP

(57) ABSTRACT

A system for monitoring and recognizing audio broadcasts is described. The system includes a plurality of geographically distributed monitoring stations, each of the monitoring stations receiving unknown audio data from a plurality of audio broadcasts. A recognition system receives the unknown audio data from the plurality of monitoring stations and compares the unknown audio data against a database of signature files. The database of signature files, or index sets, corresponds to a library of known audio files, such that the recognition system is able to identify known audio files in the unknown audio stream as a result of the comparison. The system further includes a nervous system able to monitor and configure the plurality of monitoring stations and the recognition system, and a heuristics and reporting system able to analyze the results of the comparison performed by the recognition system and use metadata associated with each of the known audio files to generate a report of the contents of plurality of audio broadcasts.

24 Claims, 12 Drawing Sheets

U.S. PATENT DOCUMENTS

| | | | | |
|---|---|---|---|---|
| 6,088,455 | A | 7/2000 | Logan et al. | |
| 6,434,520 | B1 | 8/2002 | Kanevsky et al. | |
| 6,453,252 | B1 | 9/2002 | Laroche | |
| 6,480,825 | B1 | 11/2002 | Sharma et al. | |
| 6,483,927 | B2 | 11/2002 | Brunk et al. | |
| 6,570,080 | B1 | 5/2003 | Hasegawa et al. | |
| 6,748,360 | B2 | 6/2004 | Pitman et al. | |
| 6,834,308 | B1 | 12/2004 | Ikezoye et al. | |
| 6,990,453 | B2 | 1/2006 | Wang et al. | |
| 7,082,394 | B2 | 7/2006 | Burges et al. | |
| 7,174,293 | B2 | 2/2007 | Kenyon et al. | |
| 7,194,752 | B1 * | 3/2007 | Kenyon et al. | 725/22 |
| 7,328,153 | B2 * | 2/2008 | Wells et al. | 704/231 |
| 2001/0044719 | A1 | 11/2001 | Casey | |
| 2002/0023020 | A1 | 2/2002 | Kenyon et al. | |
| 2002/0072982 | A1 | 6/2002 | Barton et al. | |
| 2002/0083060 | A1 * | 6/2002 | Wang et al. | 707/10 |
| 2002/0099555 | A1 * | 7/2002 | Pitman et al. | 704/500 |
| 2003/0086341 | A1 | 5/2003 | Wells et al. | |
| 2004/0064319 | A1 | 4/2004 | Neuhauser et al. | |
| 2004/0199387 | A1 | 10/2004 | Wang et al. | |
| 2005/0160113 | A1 * | 7/2005 | Sipusic et al. | 707/104.1 |
| 2006/0059277 | A1 * | 3/2006 | Zito et al. | 710/15 |
| 2006/0122839 | A1 | 6/2006 | Li-Chun Wang et al. | |
| 2006/0277047 | A1 | 12/2006 | DeBusk et al. | |
| 2007/0143777 | A1 * | 6/2007 | Wang | 725/18 |

FOREIGN PATENT DOCUMENTS

| | | | |
|---|---|---|---|
| WO | WO 01/04870 | A1 | 1/2001 |
| WO | WO 01/88900 | A2 | 11/2001 |
| WO | WO 02/11123 | A2 | 2/2002 |

OTHER PUBLICATIONS

Brown, M.G. et al., "Automatic Content-based Retrieval of Broadcast News", ACM Multimedia 1995, 35-43, 10 pages.

Erling Wold, et al., "Content-Based Classification, Search, and Retrieval of Audio", IEEE Multimedia, 1996, 3(3), 27-36.

Foote, J.T., "An Overview of Audio Information Retrieval", ACM-Springer Multimedia Systems, Jan. 1999, 7(1), 2-11.

Foote, J.T., "Content-Based Retrieval of Music and Audio", Multimedia Storage and Archiving Systems II, Proc. Of SPIE, 1997, 3229, 138-147.

In the United States Patent and Trademark Office, Non-Final Office Action in re:. U.S. Appl. No. 10/978,313, filed Oct. 21, 2004, Dated Aug. 14, 2008, 6 pages.

In the United States Patent and Trademark Office, Non-Final Office Action in re:. U.S. Appl. No. 10/978,313, filed Oct. 21, 2004, Dated Mar. 4, 2008, 11 pages.

In the United States Patent and Trademark Office, Non-Final Office Action in re:. U.S. Appl. No. 09/839,476, filed Apr. 20, 2001, Dated Mar. 9, 2005, 10 pages.

In the United States Patent and Trademark Office, Notice of Allowance in re:. U.S. Appl. No. 10/978,313, filed Oct. 21, 2004, Dated May 29, 2009, 7 pages.

In the United States Patent and Trademark Office, Notice of Allowance in re:. U.S. Appl. No. 10/978,313, filed Oct. 21, 2004, Dated Mar. 6, 2009, 4 pages.

In the United States Patent and Trademark Office, Notice of Allowance in re:. U.S. Appl. No. 09/839,476, filed Apr. 20, 2001, Dated Jul. 1, 2005, 3 pages.

Kashino, et al., "A Quick Search Method for Audio and Video Signals based on Histogram Pruning", 2003, IEEE, 5(3), 348-357.

Liu, S. A., "Landmark Detection for Distinctive Feature-Based Speech Recognition", J. Acoiust Soc Am, Nov. 1996, 100(5), 3417-3430.

Miller, M.L. et al., "Audio Fingerprinting: Nearest Neighbor Search in High Dimensional Binary Spaces", IEEE Multimedia Signal Processing Workshop, 2002, 182-185.

Udi Manber, "Finding Similar Files in a Large File System", Oct. 1993, Department of Computer Science, The University of Arizona, 11 pages.

Yang, C., "Music Database Retrieval based on Spectral Similarity", Mar. 28, 2001, Database Group Technical Report, Stanford University Database Group, 9 pages.

* cited by examiner

REFERENCE LIBRARY FILE COMPONENT OVERVIEW

SYSTEM AND METHOD FOR MONITORING AND RECOGNIZING BROADCAST DATA

TECHNICAL FIELD

This invention relates to recognition and identification of broadcast signals including audio and video signals, and more particularly to a system and method for monitoring multiple broadcast sources to identify individual elements such as songs or videos aired by those broadcast sources.

BACKGROUND OF THE INVENTION

There is a growing need for automatic recognition of broadcast signals such as videos, music or other audio or video signals generated from a variety of sources. Sources for the broadcast signals can include, but are not limited to terrestrial radio, satellite radio, internet audio and video, cable television, terrestrial television broadcasts, and satellite television. Because of the growing number of broadcast media, owners of copyrighted works or advertisers are interested in obtaining data on the frequency of broadcast of their material. Music tracking services provide playlists of major radio stations in large markets. Any sort of continual, real-time or near real-time recognition is inefficient and labor intensive when performed by humans. An automated method of monitoring large numbers of broadcast sources, such as radio stations and television stations, and recognizing the content of those broadcasts would thus provide significant benefit to copyright holders, advertisers, artists, and a variety of industries.

Traditionally, recognition of audio broadcasts, such as songs played on the radio has been performed by matching radio stations and times at which songs were played with playlists provided either by the radio stations or from third party sources. This method is inherently limited to only radio stations for which information is available. Other methods rely can rely on statistical sampling of broadcasts, the results of which are then used to estimate actual playlists for all broadcast stations. Still other methods rely on embedding inaudible codes within broadcast signals. The embedded signals are decoded at the receiver to extract identifying information about the broadcast signal. The disadvantage of this method is that special decoding devices are required to identify signals, and only those songs with embedded codes can be identified.

Copyright holders, such as for music or video content, are generally entitled to compensation for each instance that their song or video is played. For music copyright holders in particular, determining when their songs are played on any of thousands of radio stations, both over the air, and now on the internet, is a daunting task. Traditionally, copyright holders have turned over collection of royalties in these circumstances to third party companies who charge entities who play music for commercial purposes a subscription fee to compensate their catalogue of copyright holders. These fees are then distributed to the copyright holders based on statistical models designed to compensate those copyright holders according which songs are receiving the most play. These statistical methods have only been very rough estimates of actual playing instances based on small sample sizes.

Any large-scale recognition system requires content-based retrieval, in which an unidentified broadcast signal is compared with a database of known signals to identify similar or identical database signals. Content-based retrieval is different from existing audio retrieval by web search engines, in which only the metadata text surrounding or associated with audio files is searched. Also, while speech recognition is useful for converting voiced signals into text that can then be indexed and searched using well-known techniques, it is not applicable to the large majority of audio signals that contain music and sounds. Audio signals lack easily identifiable entities such as words that provide identifiers for searching and indexing. As such, current audio retrieval schemes index audio signals by computed perceptual characteristics that represent various qualities or features of the signal.

Further, existing large scale recognition systems are generally considered large scale as measured by the size of the database of elements, songs for example, that have been characterized and can be matched against the incoming broadcast stream. They are not large scale from the standpoint of the number of broadcast streams that can be continually monitored or the number of simultaneous recognitions that can occur.

What is needed is a system and method for recognizing elements, either video or audio, simultaneously across a large number of broadcast media streams.

BRIEF SUMMARY OF THE INVENTION

Accordingly, an embodiment of a broadcast monitoring and recognition system is described according to the concepts described herein. The system includes at least one monitoring station receiving broadcast data from at least one broadcast media stream. The system further includes a recognition system which receives the broadcast data from the at least one monitoring station, where the recognition system includes a database of signature files, each signature file corresponding to a know media file. The recognition system is operable to compare the broadcast data against the signature files to determine the identity of media elements in the broadcast data. An analysis and reporting system is connected to the recognition system and is operable to generate a report identifying the medial elements in the broadcast data which correspond to known media files.

In another embodiment a method of monitoring and recognizing broadcast data is described. The method includes receiving and aggregating broadcast data from a plurality of broadcast sources, comparing the broadcast data against signature files from a database of signature files, each signature file corresponding to a known media file, and analyzing the results of the comparison to determine the contents of the broadcast data.

In another embodiment a system for monitoring and recognizing audio broadcasts is described. The system includes a plurality of geographically distributed monitoring stations, each of the monitoring stations receiving unknown audio data from a plurality of audio broadcasts. A recognition system receives the unknown audio data from the plurality of monitoring stations, generates signatures for the unknown audio and compares the signatures for the unknown audio data against a database of signature files, where the database of signature files corresponds to a library of known audio files. The recognition system is able to identify audio files in the unknown audio stream as a result of the comparison. A nervous system is able to monitor and configure the plurality of monitoring stations and the recognition system, and a heuristics and reporting system is able to analyze the results of the comparison performed by the recognition system and use metadata associated with each of the known audio files to generate a report of the contents of plurality of audio broadcasts.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, and the advantages thereof, reference is made to the following descriptions taken in conjunction with the accompanying drawing, in which.

DETAILED DESCRIPTION OF THE INVENTION

Figure 1:
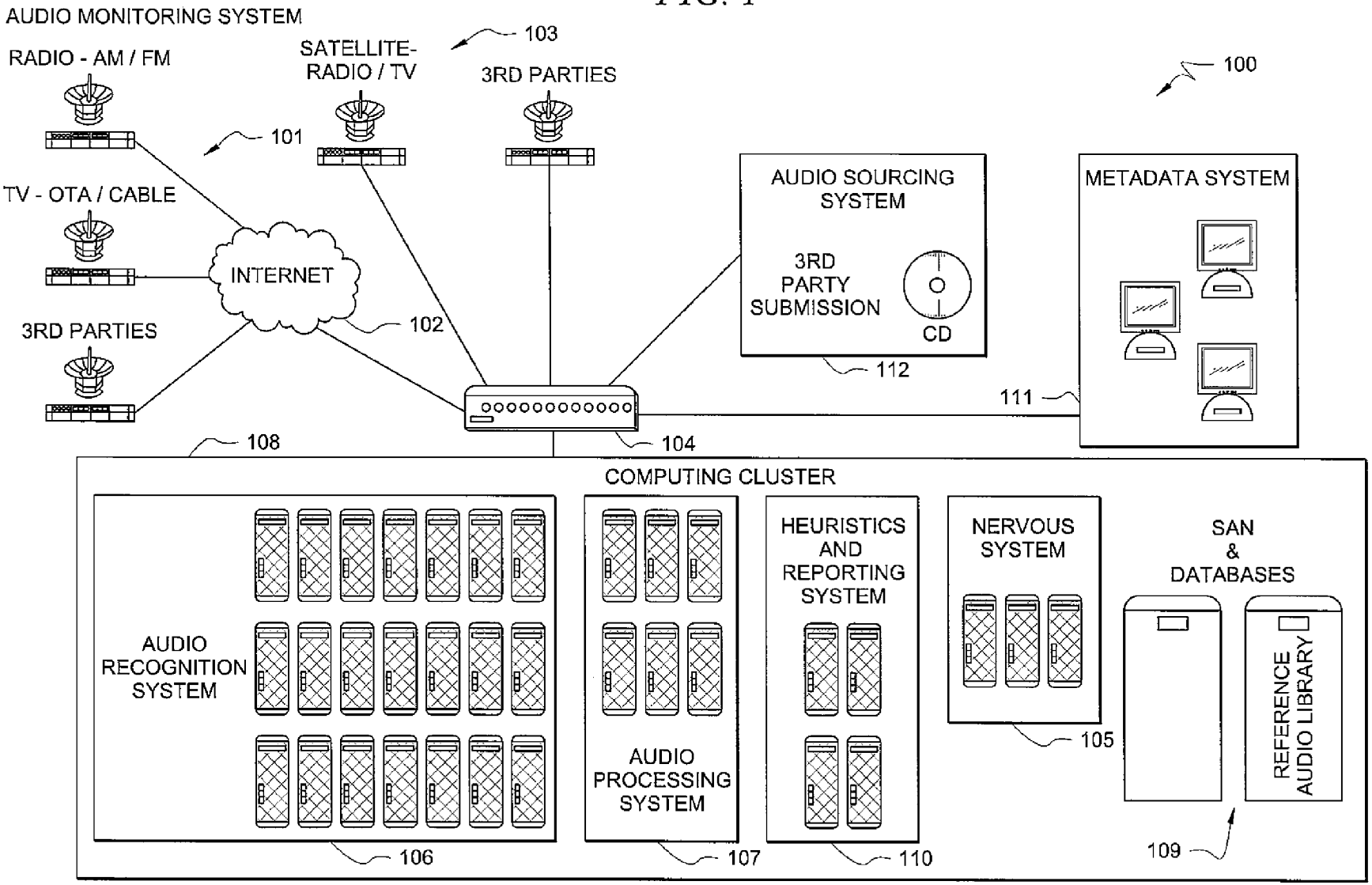
FIG. 1 is a block diagram of an embodiment of a monitoring and recognition system according to the concepts described herein.

Referring now to FIG. 1, an embodiment of a system 100 for monitoring and identifying the content of multiple broadcast sources is shown. System 100 includes multiple monitoring stations 101, 103 which are connected to a gateway 104 either directly, as shown by monitoring stations 103 or through a transport network 102. Transport network 102 could be any type of wireless, wireline, or satellite network or any combination thereof, including the Internet.

Monitoring stations 101, 103 can be geographically distributed and include hardware necessary to monitor one or more broadcasts over one or more types of broadcast media. The broadcasts can be audio and/or video broadcasts including, but not limited to over the air broadcasts, cable broadcasts, internet broadcasts, satellite broadcasts, or direct feeds of broadcast signals. Monitoring stations 101 can send the broadcast data directly over transport network 102 to gateway 104, or monitoring stations 101 can perform some initial processing on the streams to package the broadcast signals including converting analog signals into a digital format, compressing the signals, or other processing of the signals into a format preferred by the recognition system.

As will be described in greater detail with reference to FIG. 2, monitoring stations 101. 103 may also include local memory, such as hard disks, flash or random access memory, which can be used to store captured broadcast signals. The ability to store or cache the broadcast signals allows data to be maintained during network interruptions, or it allows a monitoring station to store and to batch send data at predetermined times or intervals as designated by system 100.

Nervous system 105 communicates with each monitoring station 101, 103 and maintains information about each monitoring station including configuration information. Nervous system 105 can send reconfiguration information to any of the monitoring systems 101, 103 based on changes received from system 101 or user input. Nervous system 105 will be described in greater detail with reference to FIG. 2.

Broadcast data received at gateway 104 is sent to recognition system 106, which is part of computing cluster 108. Computing cluster includes a number of configurable servers and storage devices which can be reconfigured and rearranged dynamically to meet the requirements of system 100. Recognition system 106 includes an array of servers which are used to process the broadcast signals to determine their content. Recognition system 106 works to identify content, such as audio or video elements in each broadcast signal passed to recognition system 106 by monitoring stations 101, 103. The operation of recognition system 106 will be discussed in greater detail with reference to FIG. 3. Audio processing system 107 is used to generate signature files for use in the recognition system. The generation of signature files will be discussed in greater detail with reference to FIGS. 7-9.

Recognition system 106 is able to communicate with storage area network (SAN) and databases 109 as well as heuristics reporting systems 110 and client applications 111. SAN 109 holds all of the monitored content, and data regarding the content of the broadcast signals as identified by recognition system 106. Additionally SAN 109 stores asset databases and analysis databases used to support system 100. Heuristics and reporting systems 110 is fed data by recognition system 106 and analyzes the data to correlate the results of the recognition process to provide an analysis of what is occurring within the broadcast signals. The operation of SAN 109 and heuristics and reporting systems 110 will be discussed in greater detail with reference to FIG. 4. Metadata system 111 is used to access metadata associated with each of the content files stored in the system's media library. Audio sourcing system receives submissions of new content for addition to the system's media library send the new content to the audio processing system 107 for inclusion in the system's media library.

Preferred embodiments of monitoring system 100 are highly scalable and capable of monitoring and analyzing broadcast data from any broadcast source. So long as a monitoring station is able to receive the broadcast signal the contents of that signal can be sent to the recognition system over any available transport network. Monitoring stations 101, 103 are designed to be placed where they can receive over the air, cable, internet or satellite broadcasts from particular geographic markets. For example, one or more monitoring stations can be placed in the Los Angeles area to receive and store all the broadcast signals in the Los Angeles area. The number of monitoring stations required would be determined by the number of individual signals each monitoring station is capable of receiving and storing. If there are 100 broadcast signals in the Los Angeles area and an embodiment of a monitoring station is capable of receiving and storing 30 broadcast signals, then four individual monitoring stations would be capable of collecting, storing and sending all of the broadcast signals for the Los Angeles metropolitan area.

Similarly, if Nashville, Tenn. has 20 broadcast signals, then a single monitoring station according to the embodiment described above would be capable of collecting, storing and sending all of the broadcast signals for the Nashville area. Monitoring stations could be deployed across the United States to receive each and every broadcast signal in the United States, thereby allowing for an essentially exact picture of the usage and broadcast of every video and audio element in the United States. While it may be desirable to collect and analyze the contents of every broadcast signal in a particular region or country, a more cost effective embodiment of a monitoring systems would employ monitoring stations to collect the broadcast signals for a selected number of broadcast signals, or a selected percentage of broadcast video and/or audio elements and then use statistical models to extrapolate an estimate of the total broadcast market.

For example, monitoring stations could be positioned to cover the top 200 broadcast markets, representing an estimated 80 percent of the broadcast signals in the United States. The data for those markets could then be analyzed and used to create an estimate of the total broadcast market. While the United States and certain cities have been used as an example, a monitoring system according to the concepts described herein could be used in any city, any region, any country, or any geographic area and still be within the scope of the concepts described herein.

Figure 2:
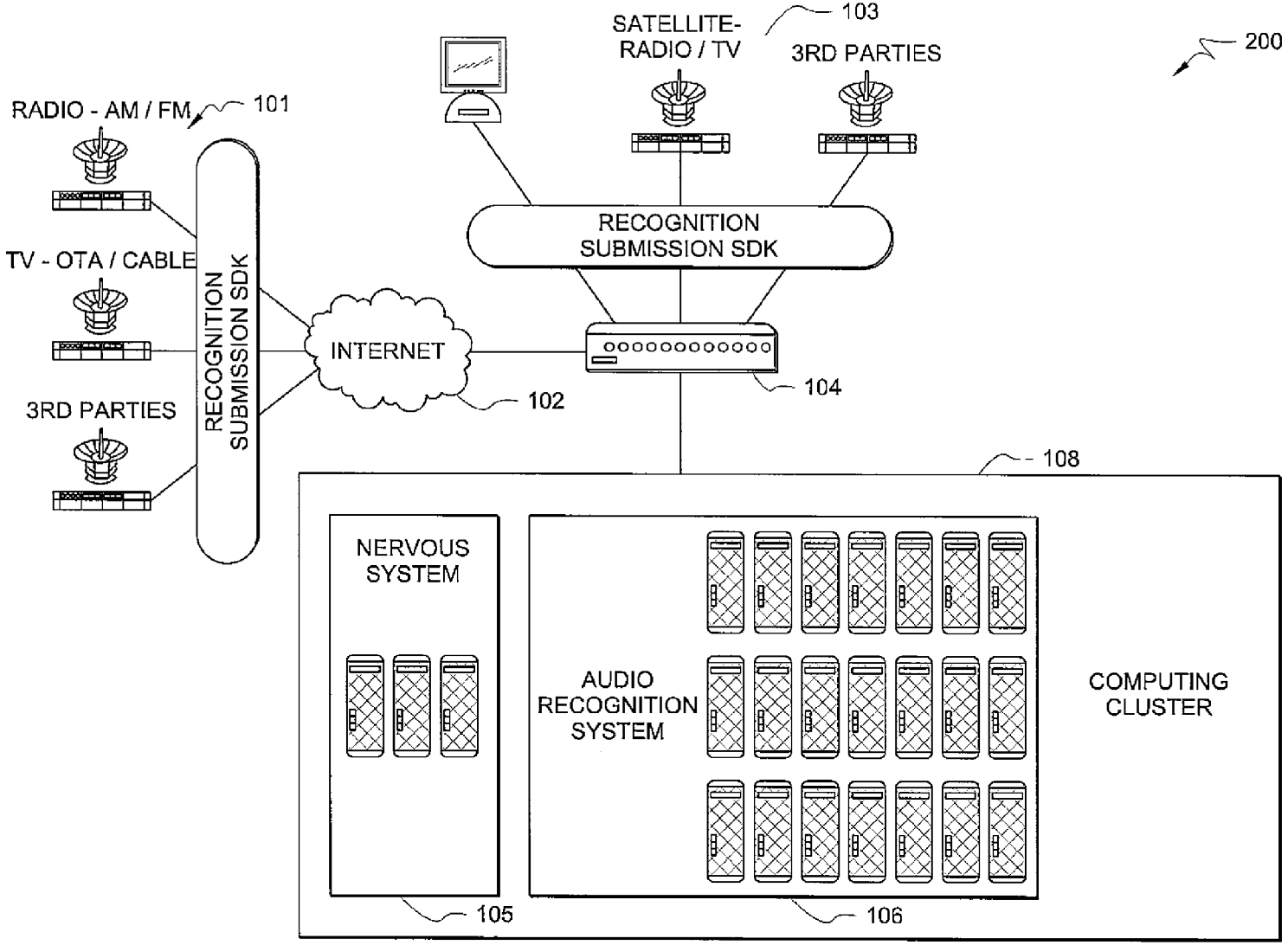
FIG. 2 is a block diagram further illustrating an embodiment of a monitoring system as shown in FIG. 1.

Referring now to FIG. 2, an embodiment of a monitoring system 200 utilizing monitoring stations 101, 103 will be described in greater detail. As described, embodiments of monitoring stations 101, 103 are configured to receive, store and send broadcast signals from a variety of sources. Embodiments of monitoring stations 101, 103 are configured to capture broadcast signals and to store the signals for a period of time in local storage such as hard disk. The amount of storage available on each monitoring station can be chosen based on the number and type of broadcast signals being monitored and the period of time the monitoring station needs to be able to store the data to ensure that it can be transmitted to the recognition system despite network outages or delays. Data can also be stored for a predetermined amount of time and batch sent during periods when the utilization of the transport network is known to be lower, such as, for example, during early morning hours.

Data is sent from the monitoring station 101 over a transport network 102, which may be any type of data network including the Internet, or over a direct connection between monitoring stations 103 and gateway 104. Data can be sent using traditional network protocols or may be sent using proprietary network protocols designed for the purpose.

Upon startup, each monitoring station is programmed to contact the servers of nervous system 105 and downloads the configuration information provided for it. The configuration information may include, but it not limited to, the particular broadcast signals for the monitoring station to monitor, requirements for storing and sending the collected data, and the address of the particular aggregator in the recognition system 106 that is responsible for the monitoring station and to which the monitoring station is to send the collected data. Nervous system 105 maintains the status information for each monitoring station 101, 103 and provides the interface through which the system or a user can create, update or alter configuration information for any of the monitoring stations. New, updated or altered configuration information is then sent from the nervous system servers to the appropriate monitoring station according to programmed guidelines.

Figure 3:
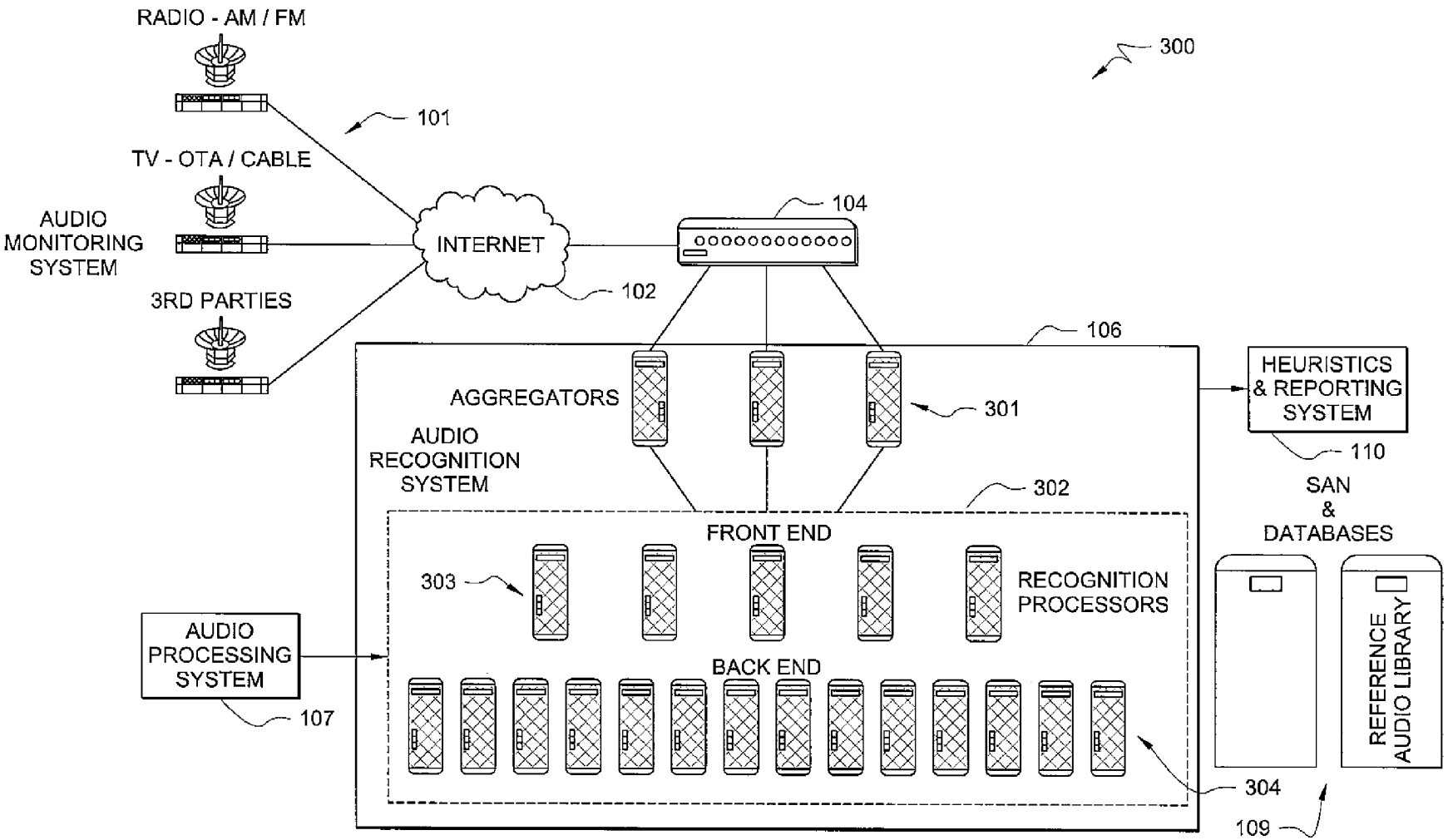
FIG. 3 is a block diagram further illustrating an embodiment of a recognition system as shown in FIG. 1.

Referring now to FIG. 3, and embodiment of a recognition system is shown. System 300 receives data collected from monitored broadcast signals by monitoring stations 101, which use transport network 102 to send the data. As stated with reference to FIG. 2, each monitoring station is assigned one or more aggregators 301 in the recognition system. Aggregators 301 collect the data, which includes broadcast data as well as source information, or other data, from the monitoring stations and deliver the broadcast data to recognition processors 302. Recognition processors 302 are associated into clusters as assigned to perform front end recognition 303 or back end recognition 304. Each cluster in front end 303 has enough associated servers to store a preliminary database of known broadcast elements, such as audio. The preliminary database stored by each cluster is made up of the necessary characteristics to identify a recognition set of the most frequently occurring broadcast elements seen in the broadcast signals. If a media sample is not recognized by the front end clusters 303, the unknown media sample is sent to the back end clusters 304. The back end clusters 304 store a larger sample of the system's media library or the entire media library and are therefore able to recognize known media segments not in the preliminary database. Both the breadth and speed of the recognition clusters can be tuned by adding more clusters or adding more servers to each cluster. Adding servers to the back end clusters allows a greater breadth of media samples to be recognized. Adding servers to the front end clusters increases the performance of the system up to a threshold based on the ratio of recognized and unrecognized samples. Adding additional clusters expands the total capacity for recognition.

By using this type of cluster processing, recognition system 106 is highly scalable and adaptable to various levels of broadcast signals needing to be identified. More servers can be added to increase the number of clusters and thereby increase the number of broadcast signals that can be effectively monitored. Additionally the number of servers per cluster and the size of the recognition set can be increased to increase recognition times, thereby increasing the throughput of recognition system 106.

Broadcast elements in the monitored broadcast signals that are not recognizable by the recognition system clusters because they are outside of the media library available to the recognition clusters, are marked as unknown as stored in SAN 109 for further processing. The further processing may include aggregation of identical unknown elements and/or manual recognition of the unknown elements. If the unrecognized samples are able to be identified by the manual process or other automated processes, the newly recognized elements are then added to the full database, or library, of know broadcast elements.

Audio processing system 107 is also operable to create, alter and manage the recognition set used by the clusters of recognition system 106. Known broadcast elements to be included in the recognition set can be identified manually or can be identified by the system based on the analysis of the incoming broadcast streams. Based on the input or analysis, audio processing system 107 combines the characteristics for each known broadcast element to be included it the recognition set into a single unit, or "slice", which is then sent to each server based on it role in its assigned cluster in recognition system 106.

The results of the recognition attempts by the recognition clusters of the recognition system are then sent to heuristics and reporting system 110 from FIG. 1 for storage and analysis.

Figure 4:
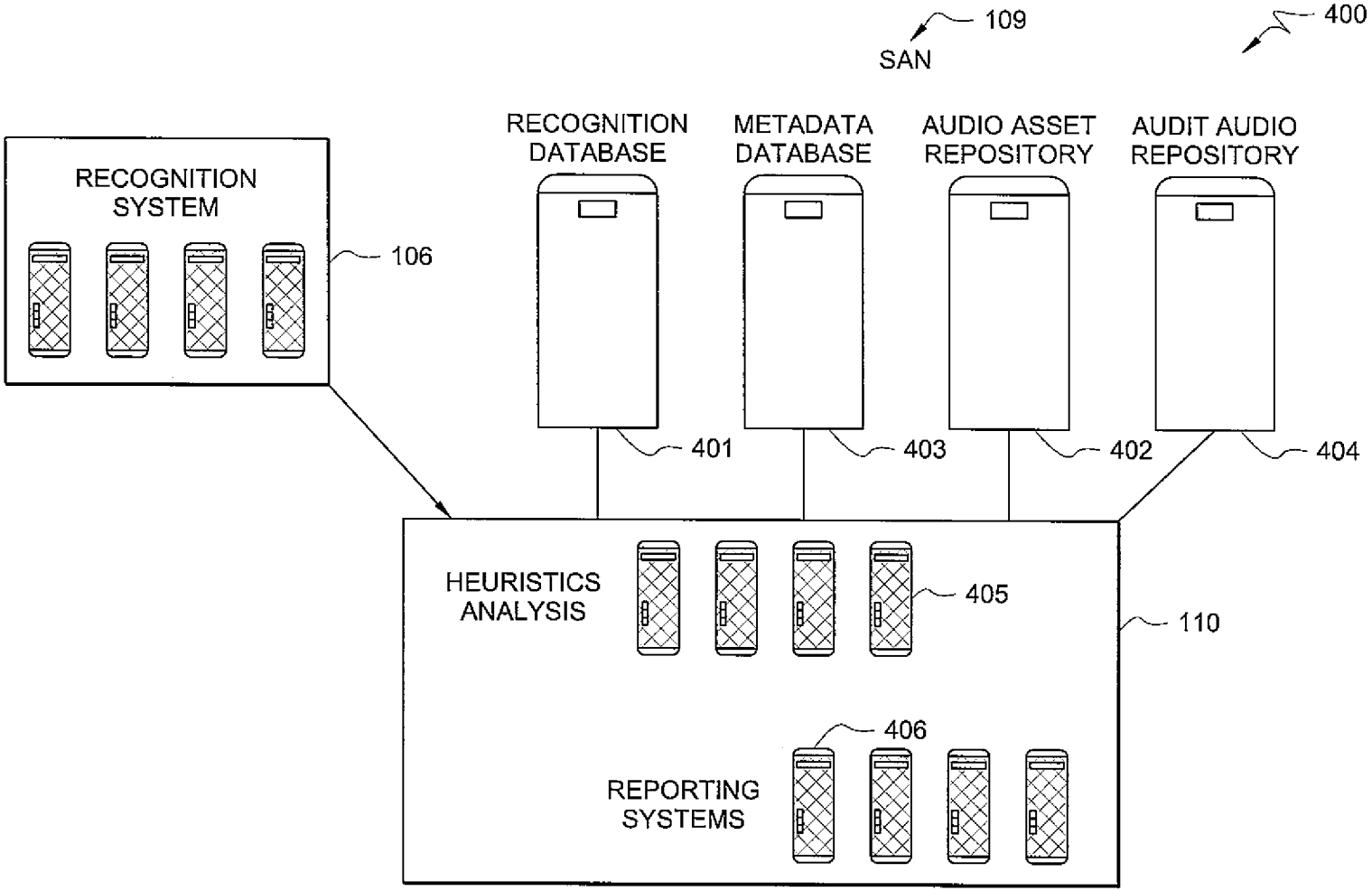
FIG. 4 is a block diagram further illustrating an embodiment of a heuristics and reporting system as shown in FIG. 1.

Referring now to FIG. 4, an embodiment of heuristics and reporting systems 110 is described in greater detail. As described, heuristics and reporting systems 110 received the aggregated data from recognition system 106 and processed for analysis and storage. Both the actual broadcast data itself is passed along with the information generated by the recognition system and any other information that has been associated with the broadcast data, such as, for example, the source information associated by the monitoring station.

Submitted data and results are taken by heuristics system 405 and correlated over time through heuristical analysis to produce an assessment of the contents of a broadcast data signal, or stream, over time. Analysis may also be done over multiple broadcast signals. The broadcast signals may be grouped in any conceivable way including, but not limited to, geographically, by broadcast type (over the air, satellite, cable, Internet, etc.), by signal type (i.e. audio, video, etc.), by genre, or any other type of grouping that may be of interest. Reports and analysis generated by reporting system 406, along with raw data and raw recognition data, can be stored on SAN 109 in recognition database 401, metadata database 403, audio asset database 402, audit audio repository 404, or on another portion of SAN 109 or database stored on SAN 109.

The output of heuristics and reporting system 110 may include raw data, raw recognition data, audit files and heuristically analyzed recognition results. User and customer access to information from the heuristics and reporting systems can be provided in any format including a selection of web services available through an Internet portal using a web based application, or other type of network access.

Figure 5:
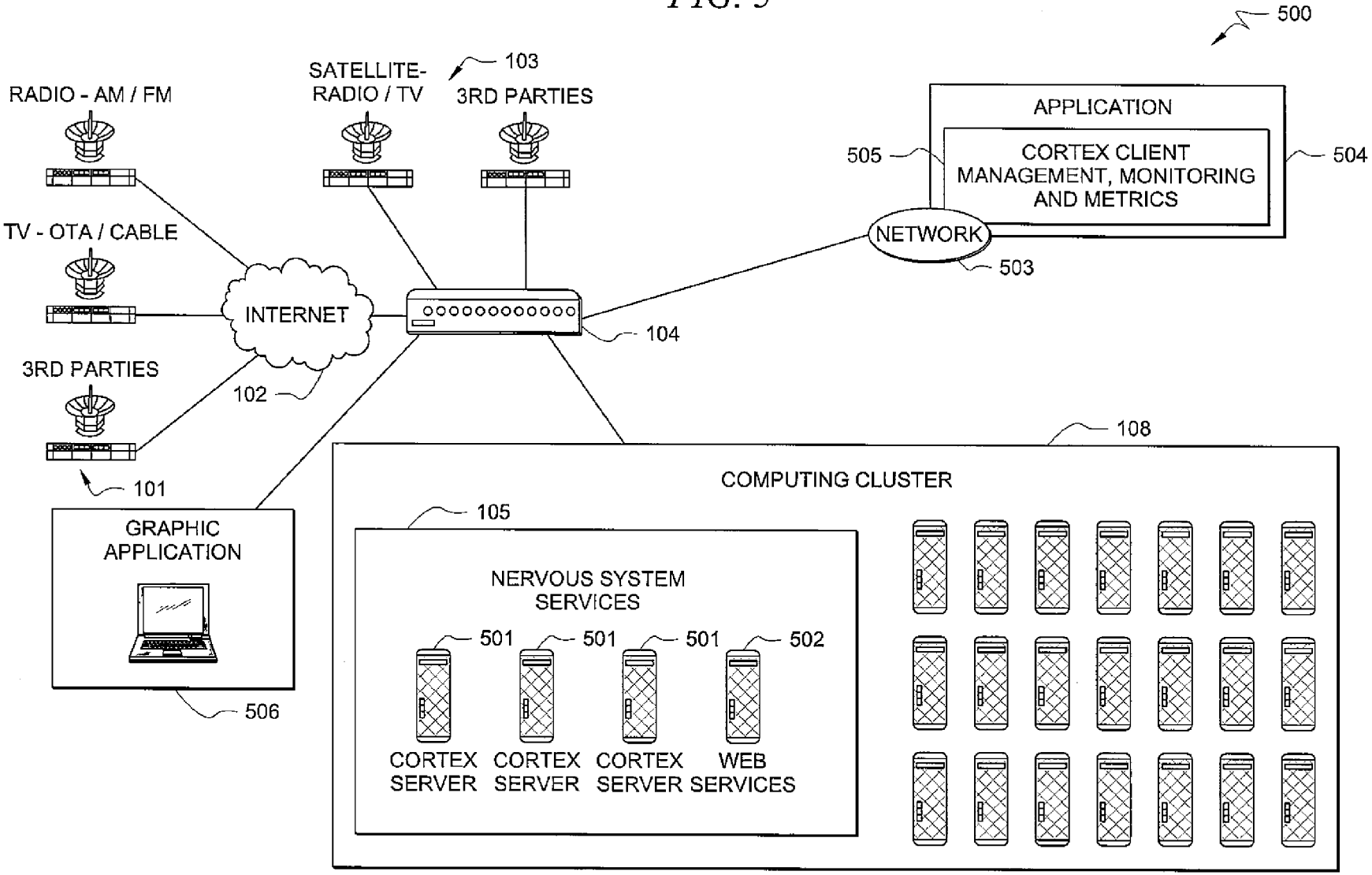
FIG. 5 is a block diagram further illustrating an embodiment of a nervous system as shown in FIG. 1.

Referring now to FIG. 5, an embodiment of nervous system network 500 controlled by nervous system 105 from FIG. 1 is described in greater detail. As described with reference to FIG. 2, nervous system 105 is used to provide configuration information to monitoring stations 101, 103. In addition to monitoring and controlling monitoring stations 101, 103, nervous system 105 is responsible for controlling the configuration and operation of the servers in the recognition system 105 and audio processing system 106.

Nervous system 105 includes cortex servers 501 which monitor, control and store configuration information for each of the machines in nervous system network 500. Nervous system 105 also includes a web server 502 which is used to provide status information and the ability to monitor, control and alter configuration information for any machine in nervous system network 500.

Upon start up every machine within nervous system network notifies a cortex server 501 in nervous system 105 of their presence and the types of services they provide. After receiving the notification of a machine's presence and services, nervous system 105 will provide the machine with its configuration. For servers in recognition system 106, nervous system 105 will assign each server to a specific task, for example as an aggregator or as a recognition server, and assign the server to a specific cluster as appropriate. Timely status messages from each machine in nervous system network 500 will ensure that nervous system 105 has a current and accurate topology of nervous system network 500 and available services. Servers in recognition system 105 can be repurposed and reassigned in real time by nervous system 105 as demand for services fluctuates or to account for failures in other servers in recognition system 105.

Applications 504 for nervous system 105 can be built using cortex client 505, which encapsulates management, monitoring and metric functions along with messaging and network connectivity. Cortex client 505 can be remote from nervous system 105 and accesses the system using network 503. Optic application 506 can also access nervous system 105 and provide a graphical front end to access cortex server and nervous system functionality.

Figure 6:
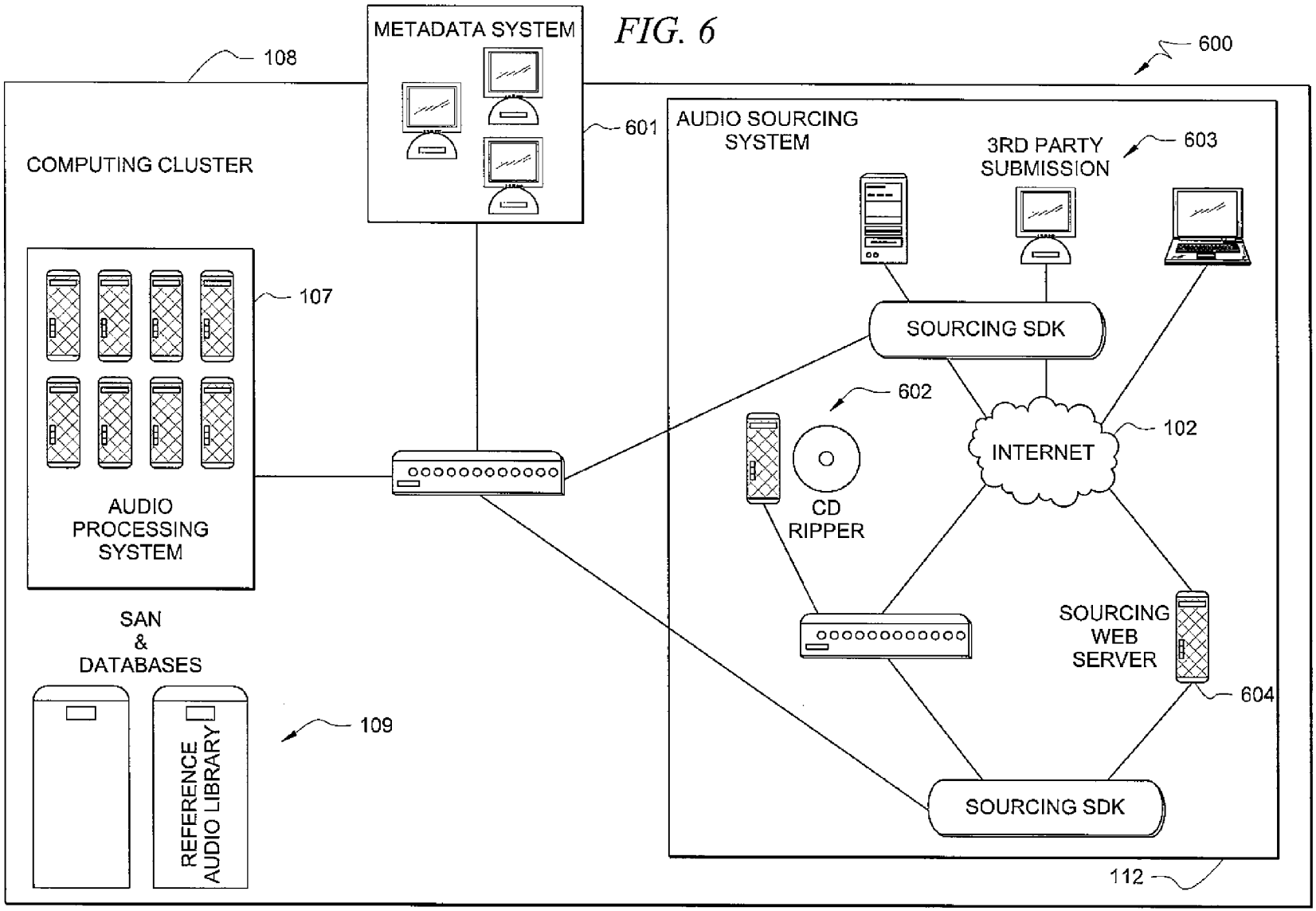
FIG. 6 is a block diagram further illustrating an embodiment of an audio sourcing system as shown in FIG. 1.

Referring now to FIG. 6, a block diagram of an embodiment of system 112 for performing an audio sourcing is described. Audio sourcing system 112 allows known media samples to be added to the media library stored in SAN 109. Known media samples are acquired from any type of source, such as, for example, a cd or dvd ripper 602, a sourcing web server 604 or third party submissions 603. Third party submissions may include artists, media publishers, content owners or other sources who desire content to be added to the media library.

New media samples to be added to the library are then sent to audio processing system 107, and their associated metadata is retrieved from metadata system 601. Audio processing system 107 takes the raw data, such as audio data, and creates signatures, landmarks/fingerprints, a lossless compression file for storage.

Figure 7:
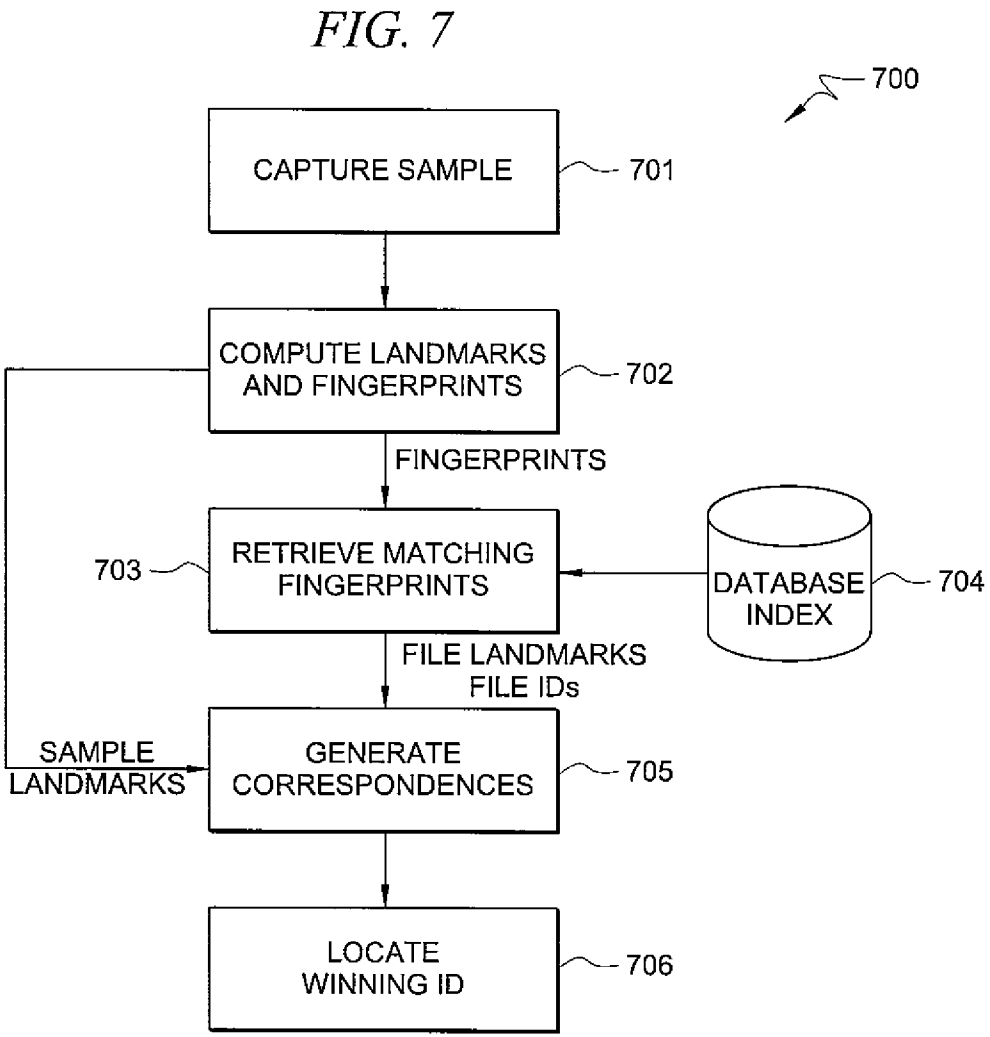
FIG. 7 is a flow chart of an embodiment of a process for recognizing a media sample.
Figure 8:
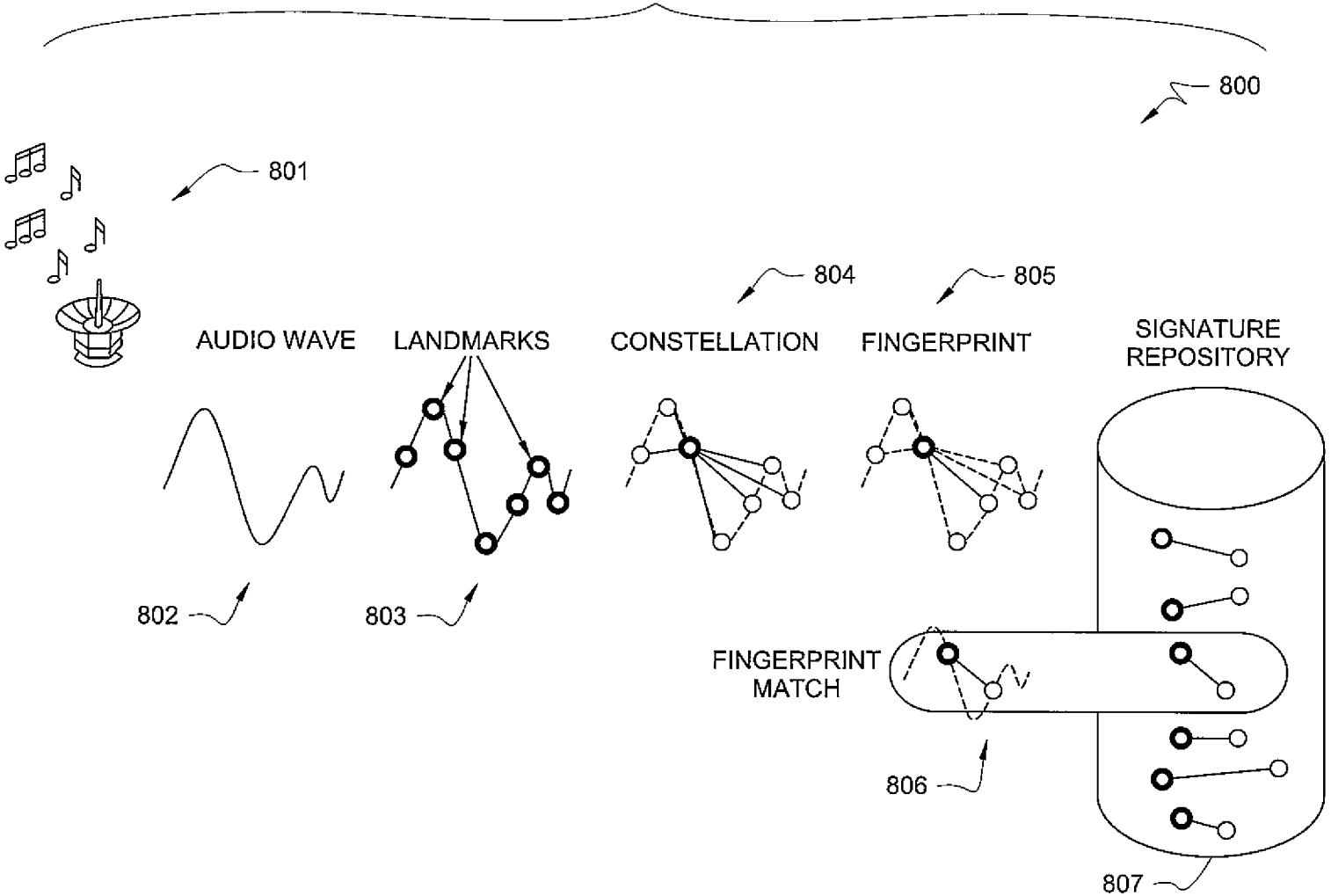
FIG. 8 is a diagram illustrating an embodiment of a landmark and fingerprinting process according to the present invention.
Figure 9:
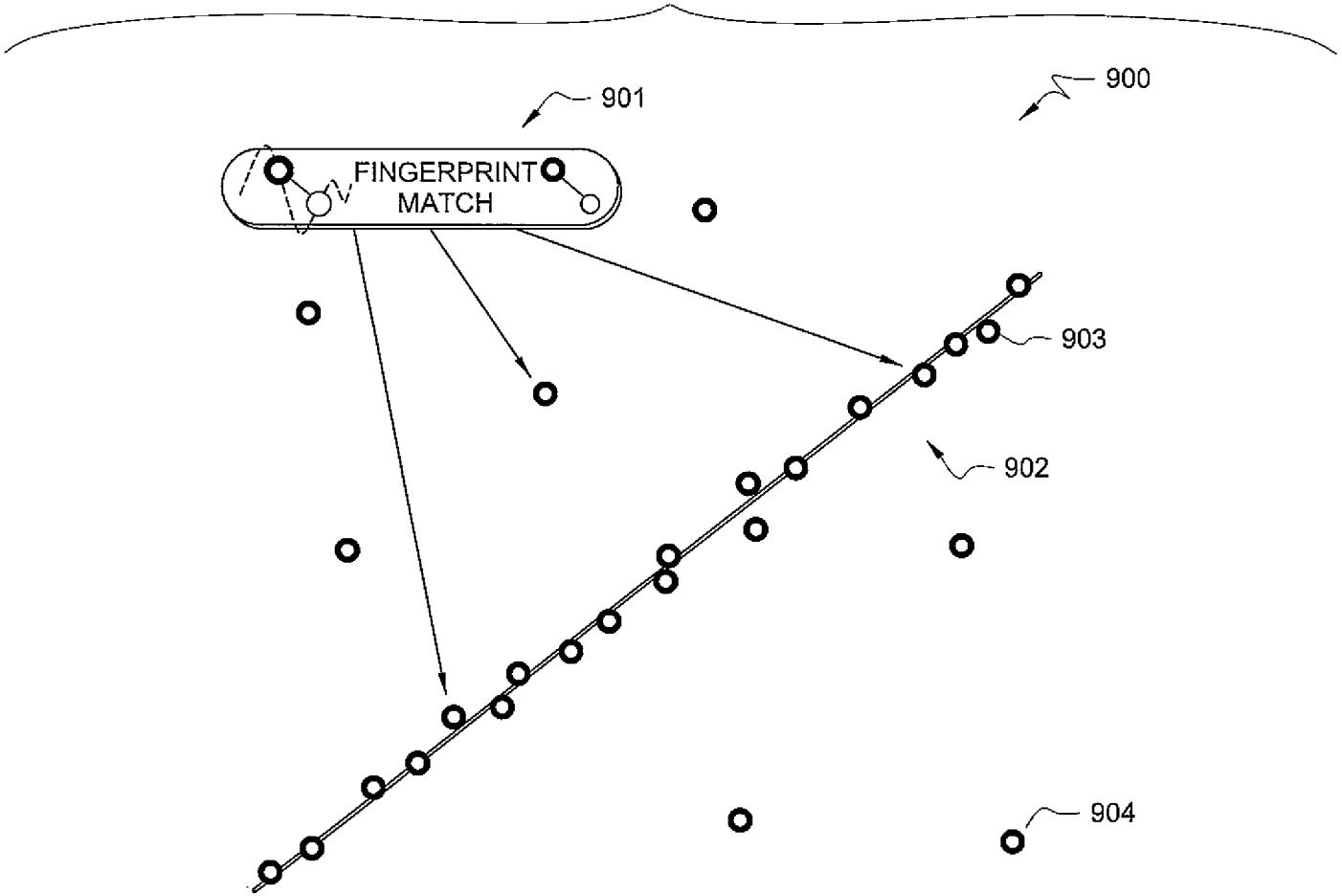
FIG. 9 is a diagram illustrating an embodiment of a matching process for landmark and fingerprint matching according to the present invention.

Referring now to FIGS. 7-9 embodiments of a landmark and fingerprinting process for identifying media samples is described. Embodiments of recognition system 105 and audio processing system 106 preferably use a recognition system and algorithm designed to allow for high noise and distortion in the captured samples. The broadcast signals could be either analog or digital signals and may suffer from noise and distortion. Analog signals need to be converted into digital signals by analog-to-digital conversion techniques.

Recognition system and audio processing system, in a preferred embodiment, use a system and method for recognizing an exogenous media sample given a database containing a large number of known media files. While reference is made primarily to audio data, it is to be understood that the method of the present invention can be applied to any type of media samples and media files, including, but not limited to, text, audio, video, image, and any multimedia combinations of individual media types. In the case of audio, the present invention is particularly useful for recognizing samples that contain high levels of linear and nonlinear distortion caused by, for example, background noise, transmission errors and dropouts, interference, band-limited filtering, quantization, time-warping, and voice-quality digital compression. As will be apparent, the recognition system works under such conditions because it can correctly recognize a distorted signal even if only a small fraction of the computed characteristics survive the distortion. Any type of audio, including sound, voice, music, or combinations of types, can be recognized by the present invention. Example audio samples include recorded music, radio broadcast programs, and advertisements.

As referred to herein, an exogenous media sample is a segment of media data of any size obtained from a variety of sources as described below. In order for recognition to be performed, the sample must be a rendition of part of a media file indexed in a database used by the present invention. The indexed media file can be thought of as an original recording, and the sample as a distorted and/or abridged version or rendition of the original recording. Typically, the sample corresponds to only a small portion of the indexed file. For example, recognition can be performed on a ten-second segment of a five-minute song indexed in the database. Although the term "file" is used to describe the indexed entity, the entity can be in any format for which the necessary values (described below) can be obtained. Furthermore, there is no need to store or have access to the file after the values are obtained.

A block diagram conceptually illustrating the overall processes of a method 700 of the present invention is shown in FIG. 7. Individual processes are described in more detail below. The method identifies a winning media file, a media file whose relative locations of characteristic fingerprints most closely match the relative locations of the same fingerprints of the exogenous sample. After an exogenous sample is captured in process 701, landmarks and fingerprints are computed in process 702. Landmarks occur at particular locations, e.g., timepoints, within the sample. The location within the sample of the landmarks is preferably determined by the sample itself, i.e., is dependent upon sample qualities, and is reproducible. That is, the same landmarks are computed for the same signal each time the process is repeated. For each landmark, a fingerprint characterizing one or more features of the sample at or near the landmark is obtained. The nearness of a feature to a landmark is defined by the fingerprinting method used. In some cases, a feature is considered near a landmark if it clearly corresponds to the landmark and not to a previous or subsequent landmark. In other cases, features correspond to multiple adjacent landmarks. For example, text fingerprints can be word strings, audio fingerprints can be spectral components, and image fingerprints can be pixel RGB values. Two general embodiments of process 702 are described below, one in which landmarks and fingerprints are computed sequentially, and one in which they are computed simultaneously.

In process 703, the sample fingerprints are used to retrieve sets of matching fingerprints stored in a database index 704, in which the matching fingerprints are associated with landmarks and identifiers of a set of media files. The set of retrieved file identifiers and landmark values are then used to generate correspondence pairs (process 705) containing sample landmarks (computed in process 702) and retrieved file landmarks at which the same fingerprints were computed. The resulting correspondence pairs are then sorted by song identifier, generating sets of correspondences between sample landmarks and file landmarks for each applicable file. Each set is scanned for alignment between the file landmarks and sample landmarks. That is, linear correspondences in the pairs of landmarks are identified, and the set is scored according to the number of pairs that are linearly related. A linear correspondence occurs when a large number of corresponding sample locations and file locations can be described with substantially the same linear equation, within an allowed tolerance. For example, if the slopes of a number of equations describing a set of correspondence pairs vary by +–0.5%, then the entire set of correspondences is considered to be linearly related. Of course, any suitable tolerance can be selected. The identifier of the set with the highest score, i.e., with the largest number of linearly related correspondences, is the winning file identifier, which is located and returned in process 706.

Recognition can be performed with a time component proportional to the logarithm of the number of entries in the database. Recognition can be performed in essentially real time, even with a very large database. That is, a sample can be recognized as it is being obtained, with a small time lag. The method can identify a sound based on segments of 5-10 seconds and even as low 1-3 seconds. In a preferred embodiment, the landmarking and fingerprinting analysis, process 702, is carried out in real time as the sample is being captured in process 701. Database queries (process 703) are carried out as sample fingerprints become available, and the correspondence results are accumulated and periodically scanned for linear correspondences. Thus all of the method processes occur simultaneously, and not in the sequential linear fashion suggested in FIG. 7. Note that the method is in part analogous to a text search engine: a user submits a query sample, and a matching file indexed in the sound database is returned.

The method is typically implemented as software running on a computer system such as recognition servers 302 from FIG. 3, with individual processes most efficiently implemented as independent software modules. Thus a system implementing the present invention can be considered to consist of a landmarking and fingerprinting object, an indexed database, and an analysis object for searching the database index, computing correspondences, and identifying the winning file. In the case of sequential landmarking and fingerprinting, the landmarking and fingerprinting object can be considered to be distinct landmarking and fingerprinting objects. Computer instruction code for the different objects is stored in a memory of one or more computers and executed by one or more computer processors. In one embodiment, the code objects are clustered together in a single computer system, such as an Intel-based personal computer or other workstation. In a preferred embodiment, the method is implemented by a networked cluster of central processing units (CPUs), in which different software objects are executed by different processors in order to distribute the computational load. Alternatively, each CPU can have a copy of all software objects, allowing for a homogeneous network of identically configured elements. In this latter configuration, each CPU has a subset of the database index and is responsible for searching its own subset of media files.

Referring now to FIG. 8, an diagram illustrating an embodiment of a process 800 that creates landmark/fingerprints for identification is shown. Process 800 begins when a broadcast signal 801 containing media content is received. In the example of FIG. 8 the content is audio, represented by audio wave 802. An embodiment of a landmark/fingerprinting process according to the concepts described herein is then applied to audio wave 802. Landmarks 803 are identified at representative points on audio wave 801.

Next, the landmarks are grouped into constellations 804 by associating a landmark with other nearby landmarks. Fingerprints 805 are formed by the vectors created between a landmark and the other landmarks in the constellation. Fingerprints from the broadcast source are then compared against fingerprints in a signature repository.

A signature in the repository is a collection of fingerprints from known media samples that have been derived and stored. Fingerprint matches 806 occur when a fingerprint from an unknown media sample matches a fingerprint in the signature repository.

Referring now to FIG. 9 a diagram illustrating an embodiment of a process 900 for correlating individual fingerprint matches 901 into matches of known media files. When an unknown media sample matches a known file in the media library individual matches will occur such as matches 903 and 904. When the individual enough individual matches begin to align such as will alignment 902 a match has occurred.

Further description of an embodiment of a recognition system which can be used in conjunction with the concepts described herein is described in United States Patent Publication No. 2002/0083060, published Jun. 27, 2002 and entitled "System and Methods for Recognizing Sound or Music Signals in High Noise and Distortion," and in United States Patent Publication No. 2005/0177372, published Aug. 11, 2005 and entitled "Robust and Invariant Audio Pattern Matching," the disclosures of which are incorporated herein by reference.

Figure 10:
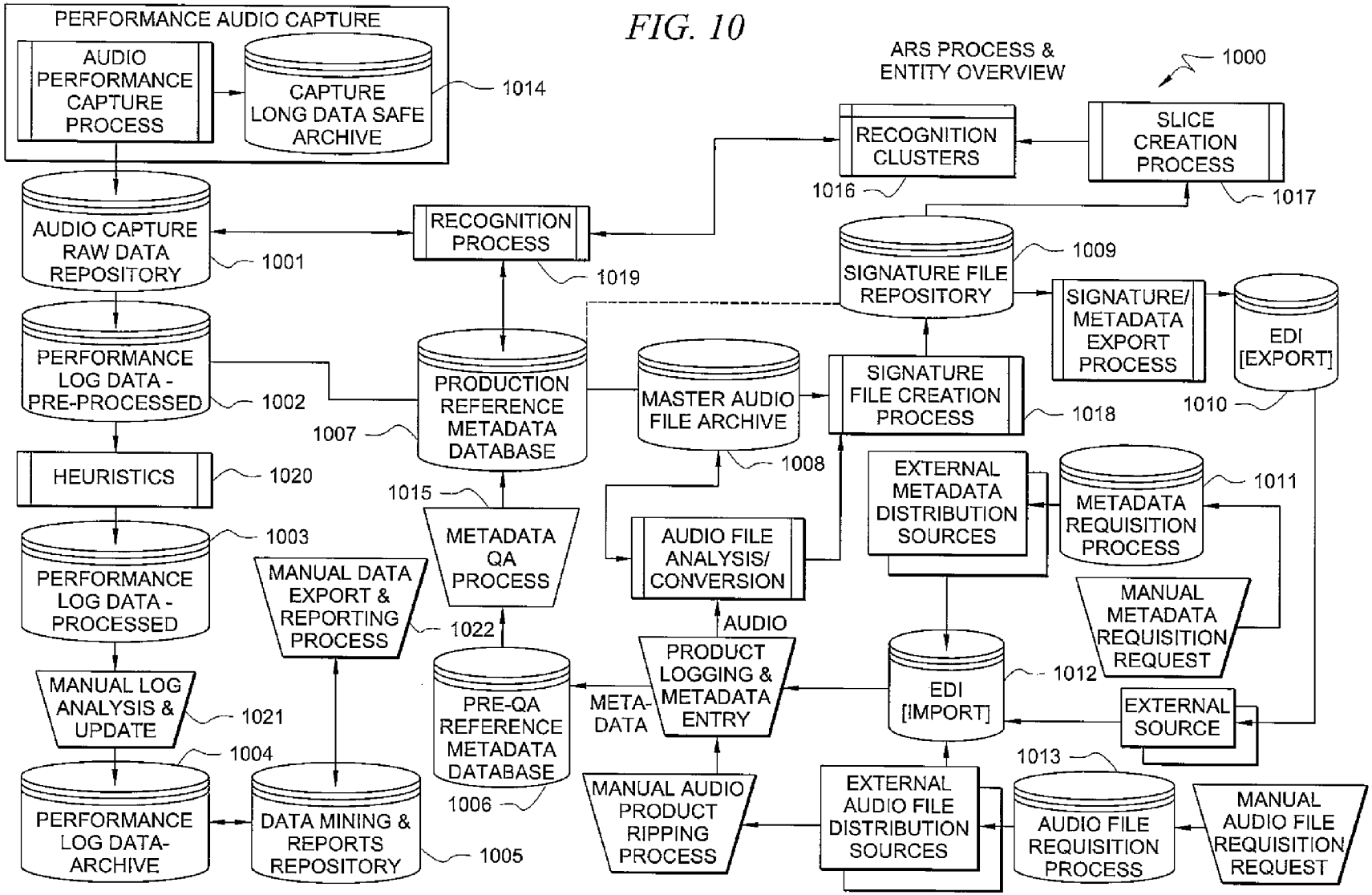
FIG. 10 is a process flow and entity chart of an embodiment of a automatic recognition system and method according to the concepts described herein.

Referring now to FIG. 10 an embodiment of a process and entity flow for an embodiment of a broadcast monitoring system according to the concepts described herein. Process and entity flow includes system repositories and associated processes that interact with those repositories. Repositories include repositories for raw and processed broadcast data and reports, metadata, and master audio data and signature files. While reference is made in FIG. 10 and in the description to FIG. 10 to the application for audio data and broadcasts, as previously described the application could include video, text or other data without departing from the scope of the concepts described herein.

Raw and processed broadcast data and report repositories include such as raw data repository 1001, pre-processed log data 1002, processed log data 1003, log data archive 1004, and data mining and reports repository 1005. In addition to the broadcast data repositories there is a capture log archive 1014 that archive captured broadcast data. Meta data repositories include pre-production metadata database 1006 and production metadata database 1007. Master audio and signature repositories include master audio database 1008 and signature file repository 1009. There are additional repositories that are used in to import and export data that is used in both the master audio file database and signature database as well as the associated metadata databases. These repositories include the electronic data exchange interface (EDI) export and import databases 1010 and 1012, respectively and audio file and metadata file requisition process repositories 1011 and 1013, respectively.

The metadata databases 1006 and 1007 contain textual information about each of the signature files in signature file repository 1009 and the link audio files in the master audio file archive 1008. All meta data received from external sources will initially be stored in the pre-production metadata database 1006. Data from external sources should be vetted in a quality assurance process 1015 before the pre-production metadata is move from pre-production database 1006 to production database 1007.

Signature file repository 1009 stores all signature files used by the recognition clusters 1016. Signature files are created by a signature creation process 1018 and stored in the repository. Signature files are pulled from the repository to create landmark/fingerprints (LMFPs) which populate the slices created by the slice creation process 1017 and sent to the recognition clusters. Master audio file database 1008 stores all audio files received in all formats. The master audio files are not normally used in the recognition process and are held for archival purposes, such as, for example, if a signature file is lost or corrupted the corresponding audio file from the master audio file database 1008 can be accessed and used to create an new signature file.

Data from the raw data repository 1001 is fed to the recognition process 1019 where it is analyzed by the recognition clusters 1016. The analyzed data is then placed in the pre-processed log database 1002. Heuristics function 1020 analyzes the processed data and generates the data stored in processed log database 1003. A manual log analysis and update process can be used to further process the data, which is stored in log data archive 1004 and data mining and reports repository 1005. Export and reporting process 1022 has access to data mining and reports repository 1005 to allow user access to processed data and reports.

Figure 11:
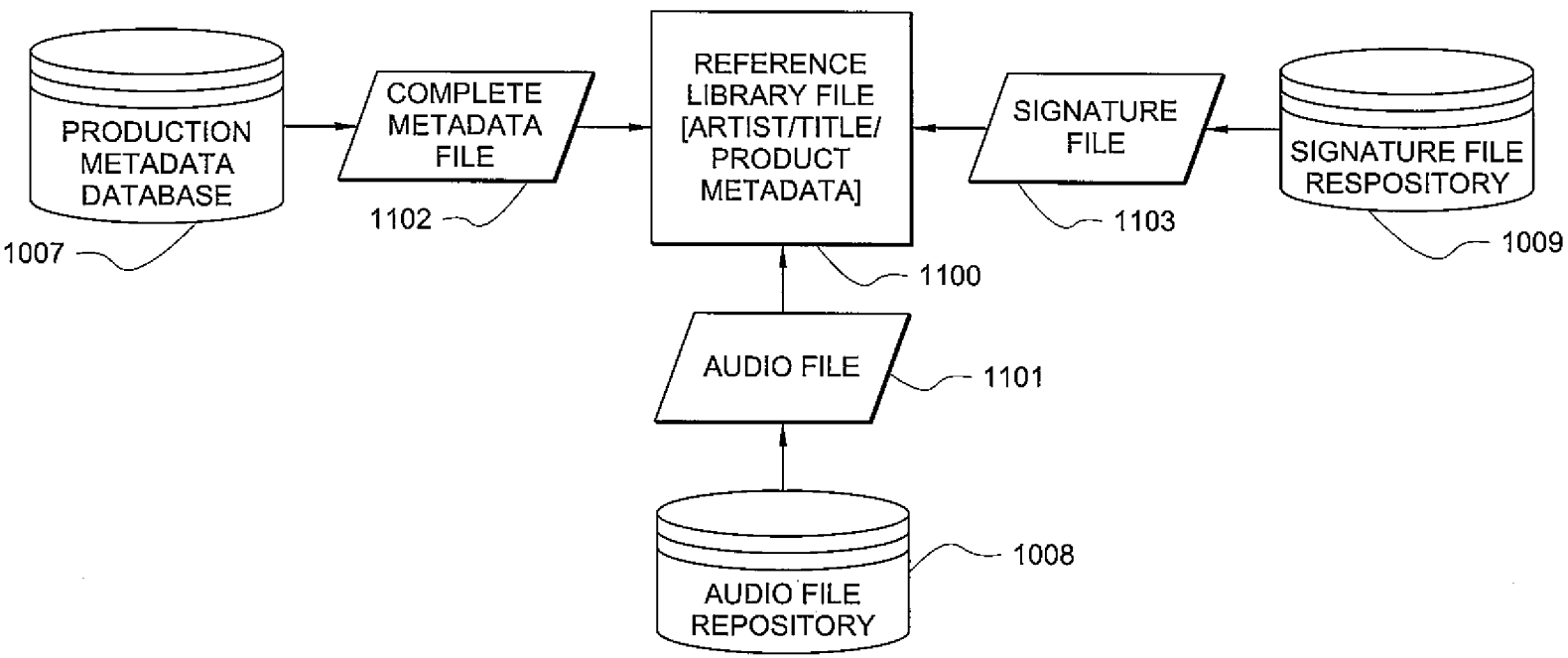
FIG. 11 is a block diagram illustrating an embodiment of a reference library and constituent components according the concepts described herein.

The production metadata database 1007, along with the signature file repository 1009 and the audio file repository 1008 together contain information that makes up a complete reference file library, as illustrated by FIG. 11. Reference file library 1100 contains a complete set of information for each audio file 1101 stored in the library. Each audio file 1101 in the library has associated with it a complete metadata file 1102 which includes information regarding the audio file such as artist, title, track length and any other data that may be used by the system in processing and analyzing broadcast data. Each audio file 1101 also has associated with it a signature file 1103 which is used to match unknown broadcast data with a known audio file in the reference library 1100. New material may be added to the reference library by supplying the new audio file, metadata file and signature file to the appropriate databases.

Figure 12:
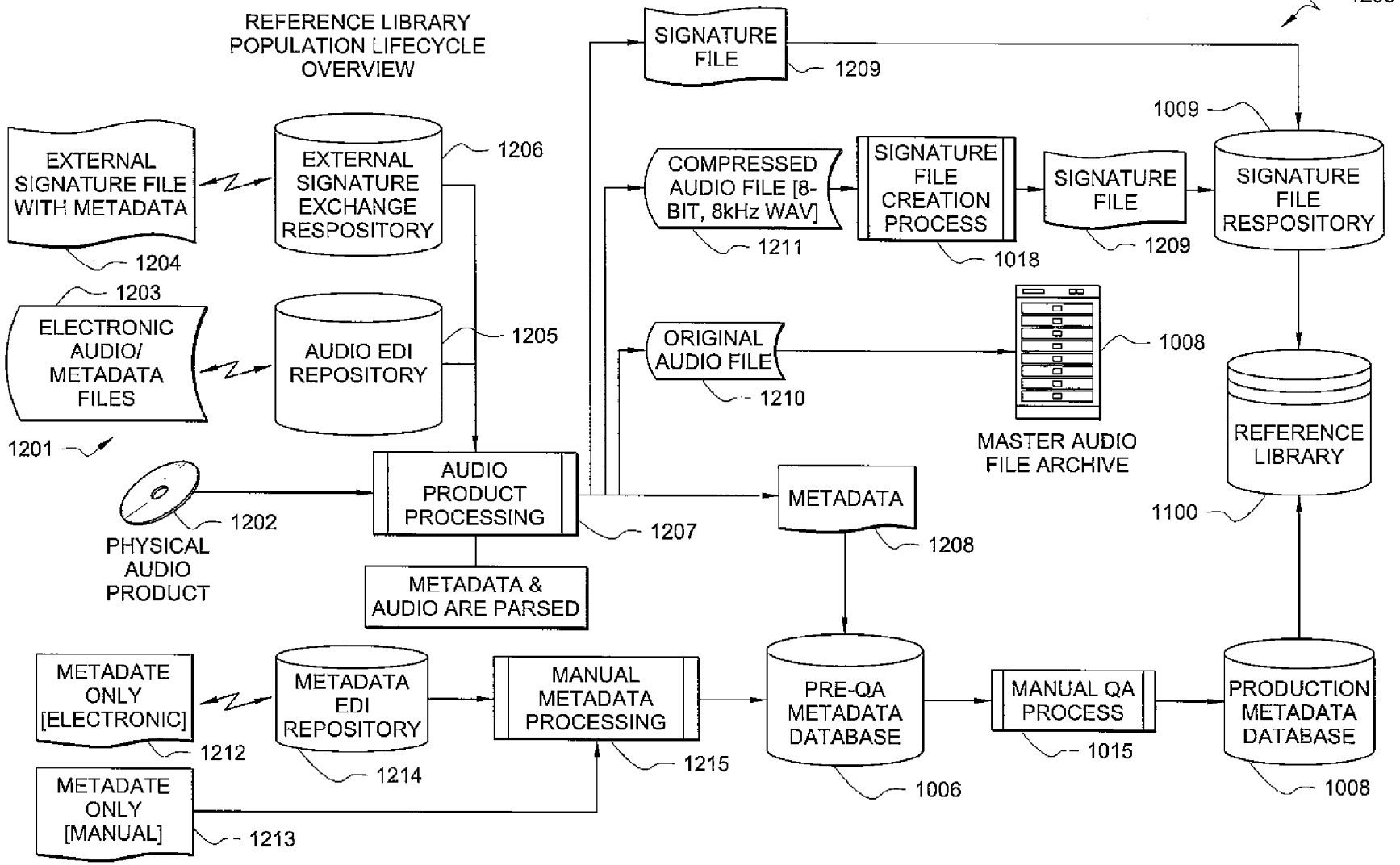
FIG. 12 is a process flow and entity chart of an embodiment of a reference library creation system and method according to the concepts described herein.

An embodiment of a reference library population process is shown in FIG. 12. Reference library 1100 may receive new audio information from multiple sources. For example, new audio files 1201 may be retrieved from a physical audio product 1202, such as a compact disc, or they may be received in electronic audio file form 1203 such as an mp3 down load from an online music repository such as ITunes. There may also be other external sources 1204 of new audio files, such as from third party companies who are contracted to supply audio files and their associated metadata for inclusion in reference library 1100. Electronic audio files 1203 are stored in an audio EDI repository 1205 while external source audio files 1204 are stored in an external signature exchange repository 1206.

All of the new audio file formats are sent to audio product processing function 1207. Audio product processing function 1207 extracts the metadata associated with the audio file and send it to the pre-processed metadata database 1006 as described in FIG. 10. The original audio file 1210 is stored in master audio file database 1008. If a signature file 1209 has already been created for the audio file, such as for external source audio files 1204, the signature file is stored directly into signature file repository 1009. If there is not a signature file for the audio file a compressed WAV file 1211 is sent to signature file creation process 1018 where a signature file 1209 is created and stored in signature file repository 1009.

For audio files that do not have associated metadata, metadata may be separately supplied for the audio file. The metadata may be obtained electronically 1212, or may be entered manually 1213. Electronically obtained metadata is stored in a metadata EDI repository 1214. Both types of metadata, electronic 1212 and manual 1213 are processed by a manual metadata process 1215 before being stored in the pre-production metadata database 1006.

One challenge in any large scale monitoring and recognition system is the development of a powerful data management system. The raw output of a monitoring and recognition system is voluminous and may not be of much use without extensive preprocessing. The amount of raw data produced is a function of the Reference Library population, system duty cycle, the audio sample length settings and the identification resolution settings. Additionally, the raw data results only differentiate between identified and unidentified segments. This allows for a very large amount of aggregated unidentified segments, which consists of content that is not included in the reference database which includes music, talk, dead air, commercials, etc. Processes should be developed to process and pre-process this raw data.

Whenever an element of broadcast data is not automatically identified by the system due to its absence from the reference database, the system can be programmed to flag the work as unknown. This unknown segment can then be saved as an unknown reference audio segment in an unknown reference library. If the audio track is subsequently logged by the system, it should be flagged for manual identification. All audio tracks marked for manual identification should be accessible via an onscreen user interface. This user interface will allow authorized users to manually identify the audio tracks. Once a user has identified the track and entered the associated metadata, all occurrences of this track on past or future monitored activity logs will appear as identified, with the associated metadata. The metadata entered against these songs must pass through the appropriate quality assurance process before it is propagated to the production metadata database.

As described, any "Unknown" audio segment that has been flagged by the heuristic algorithms must be identified through manual or automated processes. Once identified, all instances of the flagged segments should be updated to reflect the associated metadata which identifies them. Additionally, all flags should be updated to reflect the change in status from "unknown" to "identified". The manual and automated processes are described below.

All items flagged as repeated unidentified works must be easily accessed and modified manually by an authorized user. The user should be able to play the original audio track for manual identification and metadata update. Once identified, the system should propagate the updates throughout all occurrences of the previously unidentified track. Additionally, the metadata attached to the manually identified track must be flagged and submitted to the metadata import and QA system for vetting and incorporation into the Production Metadata Database.

The system should provide for the automated resubmission of items flagged as repeated unidentified works through the audio identification system until manually identified or manually removed from this cycle. This will allow the system to identify items, which may not have been initially identified due to the absence of the item's corresponding reference in the reference library, once that reference item is added to the reference library.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A broadcast monitoring and recognition system comprising:

at least one monitoring station receiving broadcast data from at least one broadcast media stream;

a recognition system receiving the broadcast data from the at least one monitoring station, the recognition system including a database of signature files, each signature file comprising a media signature, the media signature comprising a set of landmarks and a fingerprint that correspond to a known media file, the set of landmarks being dependent upon qualities within the media file, the fingerprint comprising a vector defined between landmarks in the set of landmarks, the recognition system comparing a generated signature for the broadcast data against media signatures in the signature files to identity of identify media elements in the broadcast data; and an analysis and reporting system communicatively connected to the recognition system and operable to generate a report identifying media elements in the broadcast data which correspond to known media files, wherein the recognition system comprises a plurality of recognition servers, the plurality of recognition servers organized into a first cluster of recognition servers and a second cluster of recognition servers, the first cluster of recognition servers comprising a first subset of signature files in the database of signature files against which to compare media elements in the broadcast data, the second cluster of recognition servers comprising a second subset of signature files in the database of signature files against which to compare media elements in the broadcast data, the second subset of signature files representing a larger portion of the signature files in the database of signature files than the first subset of signature files, wherein the second cluster of recognition servers relies upon the second subset of signature files representing a larger portion of the signature files in the database of signature files to identify media elements in the broadcast data after the first cluster of recognition servers relying upon the first subset of signatures fails to identify media elements in the broadcast data.

2. The system of claim 1 wherein the plurality of recognition servers comprise aggregation servers and recognition servers, the aggregation servers receiving the broadcast data and sending the broadcast data to the recognition servers for identification.

3. The system of claim 2 further comprising a nervous system operable to monitor and control the monitoring stations and the recognition system.

4. The system of claim 3 wherein the nervous system sends configuration information to each of the at least one monitoring stations and each of the aggregation servers and recognition servers.

5. The system of claim 4 wherein the nervous system is operable to reassign the function of the servers in the recognition system.

6. The system of claim 1 wherein the analysis and reporting system uses heuristic analysis to analyze the data from the recognition system.

7. The system of claim 6 wherein the analysis and reporting system is operable to generate reports based on the heuristic analysis.

8. The system of claim 1 further including a storage area network operable to store the data received by and generated by the monitoring and recognition system.

9. The system of claim 1 wherein the known media files and the database of signatures comprise a reference library.

10. The system of claim 9 wherein the reference library further comprises metadata for each known media file.

11. The system of claim 1 wherein the broadcast data is audio data.

12. The system of claim 1 wherein the broadcast data is video data.

13. A method of monitoring and recognizing broadcast data in a computing system comprising:

in a computing system receiving and aggregating broadcast data from a plurality of broadcast sources;

in the computing system generating signatures of the broadcast data; at a recognition system comprising a database of signature files and a plurality of recognition servers, the plurality of recognition servers organized into a first cluster of recognition servers and a second cluster of recognition servers, the first cluster of recognition servers comprising a first subset of signature files in the database of signature files against which to compare media elements in the broadcast data, the second cluster of recognition servers comprising a second subset of signature files in the database of signature files against which to compare media elements in the broadcast data, the second subset of signature files representing a larger portion of the signature files in the database of signature files than the first subset of signature files, the second cluster of recognition servers using the second subset of signature files representing a larger portion of the signature files in the database of signature files to identify media elements in the broadcast data after the first cluster of recognition servers relying upon the first subset of signatures fails to identify media elements in the broadcast data; and analyzing the identified media elements to determine the contents of the broadcast data, wherein each signature file comprises a media signature, the media signature comprising a set of landmarks and a fingerprint that corresponds to a known media file, the set of landmarks being dependent upon qualities within the media file, the fingerprint comprising a vector defined between landmarks in the set of landmarks.

14. The method of claim 13 further comprising generating a report based on the analysis.

15. The method of claim 14 further comprising using metadata associated with each signature file in the generation of the report.

16. The method of claim 13 wherein the broadcast data is audio data.

17. The method of claim 13 wherein the broadcast data is video data.

18. A system for monitoring and recognizing audio broadcasts, the system comprising:

a plurality of geographically distributed monitoring stations, each of the monitoring stations receiving unknown audio data from a plurality of audio broadcasts;

a recognition system receiving the unknown audio data from the plurality of monitoring stations and comparing the unknown audio data against a database of signature files, wherein each signature file comprises of a media signature, the media signature comprising of a set of landmarks and a fingerprint that correspond to a known media file, the set of landmarks being dependent upon qualities within the media file, the fingerprint comprising a vector defined between landmarks in the set of landmarks, and the recognition system being able to identify audio files in the unknown audio stream as a result of the comparison;

a nervous system able to monitor and configure the plurality of monitoring stations and the recognition system; and a heuristics and reporting system able to analyze the results of the comparison performed by the recognition system and use metadata associated with each of the known audio files to generate a report of the contents of plurality of audio broadcasts, wherein the recognition system comprises a plurality of recognition servers, the plurality of recognition servers organized into a first cluster of recognition servers and a second cluster of recognition servers, the first cluster of recognition servers comprising a first subset of signature files in the database of signature files against which to compare media elements in the broadcast data, the second cluster of recognition servers comprising a second subset of signature files in the database of signature files against which to compare media elements in the broadcast data, the second subset of signature files representing a larger portion of the signature files in the database of signature files than the first subset of signature files, wherein the second cluster of recognition servers relies upon the second subset of signature files representing a larger portion of the signature files in the database of signature files to identify media elements in the broadcast data after the first cluster of recognition servers relying upon the first subset of signatures fails to identify media elements in the broadcast data.

19. The system of claim 18 wherein the recognition system is comprised of a plurality of servers, the plurality of servers including aggregation servers and recognition servers, the aggregation servers receiving the broadcast data and sending the broadcast data to the recognition servers for identification.

20. The system of claim 18 wherein the broadcast data is audio data.

21. The system of claim 18 wherein the broadcast data is video data.

22. The system of claim 18 wherein the broadcast is an over the air radio broadcast.

23. The system of claim 18 wherein the broadcast is a satellite radio broadcast.

24. The system of claim 18 wherein the broadcast is an Internet broadcast.

* * * * *